United States Patent [19]

Vizmuller

[11] 4,422,058

[45] Dec. 20, 1983

[54] FOLDED-OVER HELICAL RESONATOR

[75] Inventor: Peter Vizmuller, Thornhill, Canada

[73] Assignee: Motorola, Inc., Schaumburg, Ill.

[21] Appl. No.: 319,849

[22] Filed: Nov. 10, 1981

[51] Int. Cl.[3] ..... H01P 1/201; H01P 1/208; H01P 7/00

[52] U.S. Cl. ..... 333/202; 333/219; 333/235; 333/222

[58] Field of Search ..... 333/219, 202, 206–208, 333/222–223, 227–235; 334/6, 41–44, 85; 336/84 R, 84 C, 225

[56] References Cited

U.S. PATENT DOCUMENTS 1,575,824 3/1926 Eiffert .
2,431,045 11/1947 Johnson .
2,843,683 7/1958 Lewis, Jr. .
3,621,484 11/1971 Shult ..... 334/41
3,851,830 12/1974 Barthalon .
3,936,776 2/1976 Sundquist ..... 333/202
3,987,386 10/1976 Valliere .

*Primary Examiner*—Marvin L. Nussbaum
*Attorney, Agent, or Firm*—James W. Gillman; Edward M. Roney

[57] ABSTRACT

A helical resonator includes a helical coil with one end flared out and folded back over a portion of the cylindrical helix made by the coil to create a winding of opposite pitch superimposed over the cylindrical helix. As an alternative design, a resonator is formed of a helical coil of a first length connected to a helical of opposite pitch. This resonator inhibits a third harmonic resonance but re-resonates around the fourth harmonic. When this resonator is used in combination with a conventional helical resonator, the undesired re-resonances are suppressed.

6 Claims, 4 Drawing Figures

FILTER WITH RE-RESONANCE RATIO n=4

FILTER WITH ALTERNATING n=3 AND n=4 RESONATORS

FOLDED-OVER HELICAL RESONATOR

This invention relates to an improved resonator and, more particularly, an improved resonator of the type that includes a folded-over helical coil, or equivalent design that suppresses harmonic resonances.

BACKGROUND OF THE INVENTION

U.S. Pat. No. 3,936,776 to John Robert Sundquist shows a helical resonator filter with a conductor having two tightly-coupled portions of like pitch and interspersed turns and a pair of respective opposite ends of the portions being connected directly to the shield or cavity of the individual resonator. The resonator described in this patent provides odd harmonic suppression. However, the relative positions of the two interspersed coils is believed to be somewhat critical, thus rendering the resonator difficult to construct. In addition, this type of resonator has a reduced tuning range because of the capacitive coupling between its windings.

SUMMARY OF THE INVENTION

It is an object of the present invention to provide an improved helical resonator that overcomes the aforementioned shortcomimgs of the prior art resonator.

It is another object of the present invention to provide a resonator of a simpler design, yet one which provides an improved performance characteristic.

It is yet another object of the present invention to provide a filter which suppresses odd, as well as even, harmonics.

The foregoing and other objects of the present invention are attained by a resonator that has a conductive helical coil in a cylindrical form forming a helical transmission line. The coil has one end flared out and folded over a portion of a helical coil formed in the cylindrical form, thereby forming a winding of opposite pitch superimposed over the coil. A resonator thus formed does not exhibit a third harmonic resonance but re-resonates around the fourth harmonic.

It is yet another aspect of the present invention that the inner coil winding under the outer flared-out and folded-over portion is removed. This provides a helical coil with one pitch connected to a helical coil of an opposite pitch.

It is a further aspect of this invention to combine the aforedescribed resonator in combination with conventional resonators whereby a resulting filter suppresses all undesired even and odd harmonic re-resonances.

The foregoing and other objects and aspects of the present invention will become clearer from the following detailed description of an illustrative embodiment of the present invention in conjunction with the accompanying drawings.

DETAILED DESCRIPTION OF THE INVENTION

Figure 1:
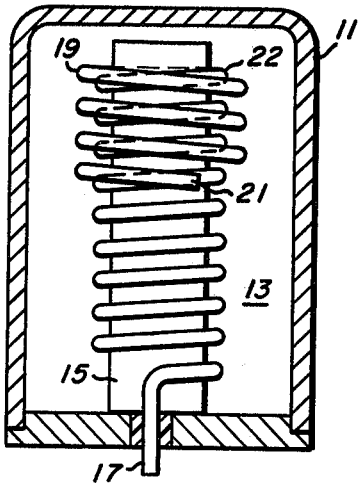
FIG. 1 shows a view of a resonator with a partially folded-over helical coil disposed in an electrical shield forming the cavity of the resonator.

As illustrated in FIG. 1, a helical resonator generally includes a grounded conductor or shield 11 forming an enclosed cavity 13 space of a suitable dimension. Typically a helical coil made of a conductive wire is disposed in the cavity and held in position by a dielectric member 15. An end 17 of the coil wire is connected to the housing 11 and the wire is wound into a helix extending into the cavity space, and typically, according to the prior art, the other end of the coil wire terminates free at the opposite end.

More recently, further changes have been made to the coil form to overcome odd harmonics generated by such a form. The aforementioned patent illustrates such a variation. There, a helical coil is formed by two windings with the turns interspersed and of like pitch.

Figure 2:
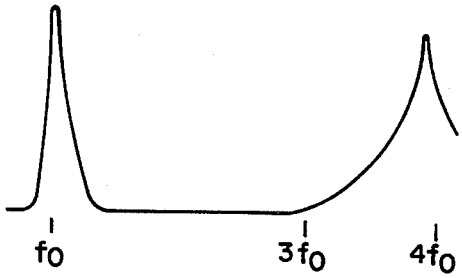
FIG. 2 shows the resonance characteristics of the present resonator.

According to the present invention, the resonator is redesigned so that the odd harmonic re-resonance is inhibited and shifted to an even harmonic. More specifically, it is found that as resonator made in accordance with the present invention, a third re-resonance odd harmonic $3f_o$ is inhibited, and in its place a harmonic resonance near the fourth harmonic $4f_o$ is provided as illustrated in FIG. 2.

The foregoing is accomplished by flaring the ungrounded end of the helical coil out and folding back over a portion of the base portion of the coil, as illustrated in FIG. 1. The folded-back part is wound over the base helix forming the original transmission line to provide an opposite pitch. The folded-over part is about one-third way over the base part in a specific example and found to be satisfactory in a specific case as illustrated in FIG. 1. The free end 21 of the coil is disposed free, as shown in FIG. 3, or may be soldered onto the base coil.

Theoretical considerations supported by experimental findings also indicate that the inner winding under the flared out and doubled over portion is not necessary for the intended operation of this resonator and can be deleted without any penalty. As illustrated in FIG. 3, 31, after deleting this inner portion, we end up with a much simpler structure, where a short length $l_2$ of reverse pitch helix is electrically connected to the top of a longer section of normal pitch $l_1$. This modified resonator can still be called a folded resonator since the wire of which it is wound has to fold back on itself to create a winding of reverse pitch.

It is found that the present resonator does not exhibit a third harmonic resonance, but re-resonates around the fourth harmonic. This is illustrated in the form of a resonance waveform shown in FIG. 2. Note there that re-resonance taken place at approximately 4 times resonance frequency, $f_o$, and not at $3f_o$. Thus, when this type of resonator is used in combination with conventional helical resonators, which does not resonate at fourth harmonic, all the undesired re-resonances are suppressed.

Figure 3:
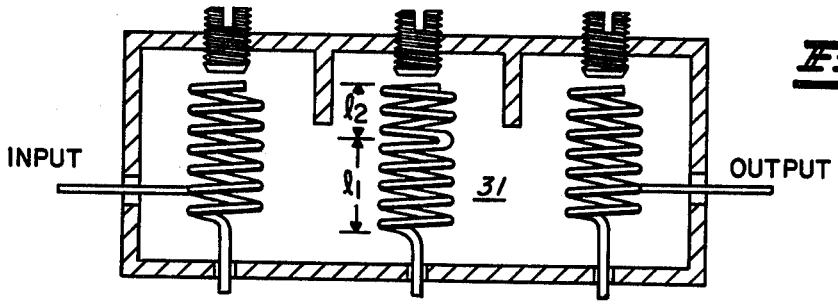
FIG. 3 shows a possible filter constructed with alternating conventional and folded resonators.

FIG. 3 shows a three resonator filter where the middle coil is a folded resonator as described before. The fundamental, or desired response of this filter is unaltered when compared to a conventional filter, while the re-resonant or undesired responses are attenuated, since the re-resonant frequencies do not coincide.

Figure 4:
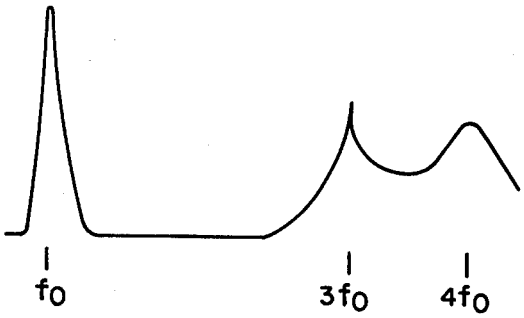
FIG. 4 shows the frequency response of the filter of FIG. 3, where all re-resonances are suppressed by at least 30 db.

FIG. 4 shows the frequency response of the filter of FIG. 3 where all re-resonances are essentially suppressed by 30 db. The advantage of this resonator over others that exhibit even-order re-resonances is that the desired result is obtained with the minimal change in the resonantor design. The advantage is gained by merely changing the pitch of the middle resonator as described above.

What is claimed is:

1. In a helical resonator which includes a housing to form a conductive shield and a helical conductive coil disposed within the housing, the improvement characterized by the conductive coil having a first portion being wound to form a cylindrical helix having a given pitch with one end of the first portion being connected to the housing, and a second portion extending from the first portion and being wound to create a winding of opposite pitch so as to eliminate third harmonic re-resonance.

2. A helical resonator filter wherein the resonator of the type according to claim 1 is used with a conventional helical resonator of the type that has only the first portion of the helical coil, whereby all undesired re-resonance harmonics are suppressed.

3. A helical resonator filter according to claim 1, wherein the end of the second portion is disposed in the cavity space formed by the shield.

4. A helical resonator filter according to claim 1, wherein the end of the second portion is connected electrically to the first portion

5. A helical resonator as set forth in claim 1 wherein the second portion of the coil is flared over and folded back over a part of the first portion of the coil.

6. A helical resonator as set forth in claim 1 wherein the second portion of the coil has a diameter which is substantially equal to the diameter of the first portion and, at the interface between the first and second portions, the coil undergoes as reversal in the direction of its winding.

* * * * *